US008671469B1

(12) United States Patent
LaMura

(10) Patent No.: US 8,671,469 B1
(45) Date of Patent: Mar. 18, 2014

(54) TOILET SEAT SYSTEM FOR RAISING AND LOWERING TOILET SEAT

(76) Inventor: Robert LaMura, Dania Beach, FL (US)

( * ) Notice: Subject to any disclaimer, the term of this patent is extended or adjusted under 35 U.S.C. 154(b) by 686 days.

(21) Appl. No.: 12/846,139

(22) Filed: Jul. 29, 2010

Related U.S. Application Data

(60) Provisional application No. 61/258,015, filed on Nov. 4, 2009.

(51) Int. Cl.
*A47K 13/10* (2006.01)

(52) U.S. Cl.
USPC ..... 4/246.1

(58) Field of Classification Search
USPC ..... 4/246.1–246.5
See application file for complete search history.

(56) References Cited

U.S. PATENT DOCUMENTS

| | | | | |
|---|---|---|---|---|
| D185,683 | S | 7/1959 | Smoyer | |
| 4,578,830 | A * | 4/1986 | Chuang | 4/246.3 |
| 5,153,946 | A | 10/1992 | Yoke et al. | |
| 5,400,442 | A | 3/1995 | Pendlebury | |
| 5,713,084 | A * | 2/1998 | Greco | 4/246.1 |
| 5,878,444 | A | 3/1999 | Convoy | |
| 6,067,667 | A | 5/2000 | Suzuki | |
| 6,226,804 | B1 * | 5/2001 | Ballard | 4/246.1 |
| 6,792,626 | B1 * | 9/2004 | Smeal et al. | 4/246.1 |
| 6,915,532 | B1 * | 7/2005 | Mohammed | 4/246.1 |
| 2004/0038121 | A1 * | 2/2004 | Song et al. | 429/97 |
| 2009/0106885 | A1 * | 4/2009 | Sagre | 4/246.1 |

* cited by examiner

*Primary Examiner* — Gregory L. Huson
*Assistant Examiner* — Lauren Heitzer

(57) ABSTRACT

A toilet seat system for lowering the toilet seat featuring a housing; a rotation lever pivotally attached in the inner cavity of the housing; a lift arm attached to the rotation lever and extending outwardly from the housing, the lift arm is for securing to a bottom surface of a toilet seat; mounting brackets for mounting the housing to a toilet seat; a motor operatively connected to the rotation lever, the motor is adapted to pivot the rotation lever and lift arm together upwardly and downwardly between at least a horizontal position and a vertical position; a microprocessor and a sensor activated when the toilet seat is lifted, the microprocessor is receives an input signal from the sensor when the sensor is activated whereupon the microprocessor generates an output command to the motor to move the rotation lever and lift arm to the horizontal position after a time delay.

1 Claim, 7 Drawing Sheets

TOILET SEAT SYSTEM FOR RAISING AND LOWERING TOILET SEAT

CROSS REFERENCE

This application claims priority to U.S. provisional application Ser. No. 61/258,015 filed Nov. 4, 2009, the specification of which is incorporated herein by reference in its entirety.

FIELD OF THE INVENTION

The present invention is directed to a toilet accessory, more particularly to a system for automatically raising or lowering the toilet seat.

BACKGROUND OF THE INVENTION

Many people, particularly women, complain that men always leave the toilet seat up. The present invention features a toilet seat system for raising and lowering the toilet seat. The system of the present invention helps to eliminate the need for men to remember to put the toilet seat down or women to have to touch the toilet seat to move it down. This can help improve hygiene and provide a more sanitary environment. The system of the present invention can also help physically impaired individuals raise and lower the toilet seat.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY

The present invention features a toilet seat system for lowering the toilet seat. In some embodiments, the system comprises a lift arm housing, wherein a slot is disposed in a hypotenuse panel of the lift arm housing; a rotation lever pivotally attached in the inner cavity of the lift arm housing; a lift arm having a first end and a second end, the first end of the lift arm is attached to the rotation lever and the second end of the lift arm extends outwardly from the slot of the lift arm housing, the lift arm is for securing to a bottom surface of a toilet seat; a top mounting bracket and a bottom mounting bracket for together mounting the lift arm housing to either a first side or a second side of a toilet, wherein each mounting bracket has a first end for attaching to a side wall of the lift arm housing and a second end with an indentation adapted to snugly wrap around standard lid screws of the toilet; a motor operatively connected to the rotation lever, the motor is adapted to pivot the rotation lever and lift arm together upwardly and downwardly between at least a horizontal position and a vertical position; a power source operatively connected to at least the motor; a microprocessor operatively connected to the motor; and a sensor disposed on the lift arm housing operatively connected to the microprocessor.

In some embodiments, the sensor is activated only when an individual lifts the toilet seat and thus lifts the rotation lever and lift arm to the vertical position, wherein the microprocessor is configured to receive an input signal from the sensor when the sensor is activated whereupon the microprocessor generates an output command to cause the motor to move the rotation lever and lift arm to the horizontal position after a time delay. In some embodiments, the sensor is adapted to detect motion within a range, wherein the microprocessor is configured to receive an input signal from the sensor when the sensor detects motion within the range whereupon the microprocessor generates an output command to cause the motor to move the rotation lever and lift arm to the horizontal position after a time delay.

In some embodiments, the lift arm housing is generally triangular in shape comprising a horizontal bottom panel, a vertical back panel, two side panels, and a curved hypotenuse panel. In some embodiments, the lift arm is removably attached to the rotation lever. In some embodiments, a male connecting end is disposed on the first end of the lift arm that engages a female connecting end on an end of the rotation lever. In some embodiments, the lift arm is generally flat. In some embodiments, the lift arm is curved inwardly with respect to the rotation lever so as to be able to be positioned below the bottom surface of the toilet seat.

In some embodiments, the motor is an electric mechanism or a hydraulic/air clutch mechanism. In some embodiments, the power source is stored in a battery pack, the battery pack being removably attached to the lift arm housing. In some embodiments, the toilet seat system further comprises a release button disposed on the housing for allowing the battery back to be released. In some embodiments, the time delay is two minutes, three minutes, four minutes, or five minutes. In some embodiments, the range is between about 0 to 5 inches, between about 0 to 10 inches, between about 0 to 15 inches, or between about 0 to 20 inches.

DESCRIPTION OF PREFERRED EMBODIMENTS

Referring now to FIG. 1-8, the present invention features a toilet seat system 100 for raising and lowering the toilet seat. The system 100 of the present invention helps to eliminate the need for men to remember to put the toilet seat down or women to have to touch the toilet seat to move it down. The system 100 of the present invention can also help physically impaired individuals raise and lower the toilet seat. In some embodiments, the system 100 can be modified to raise and/or lower the toilet lid as well. The system 100 of the present invention can be designed for installation on either right side or left side of toilet.

Figure 1:
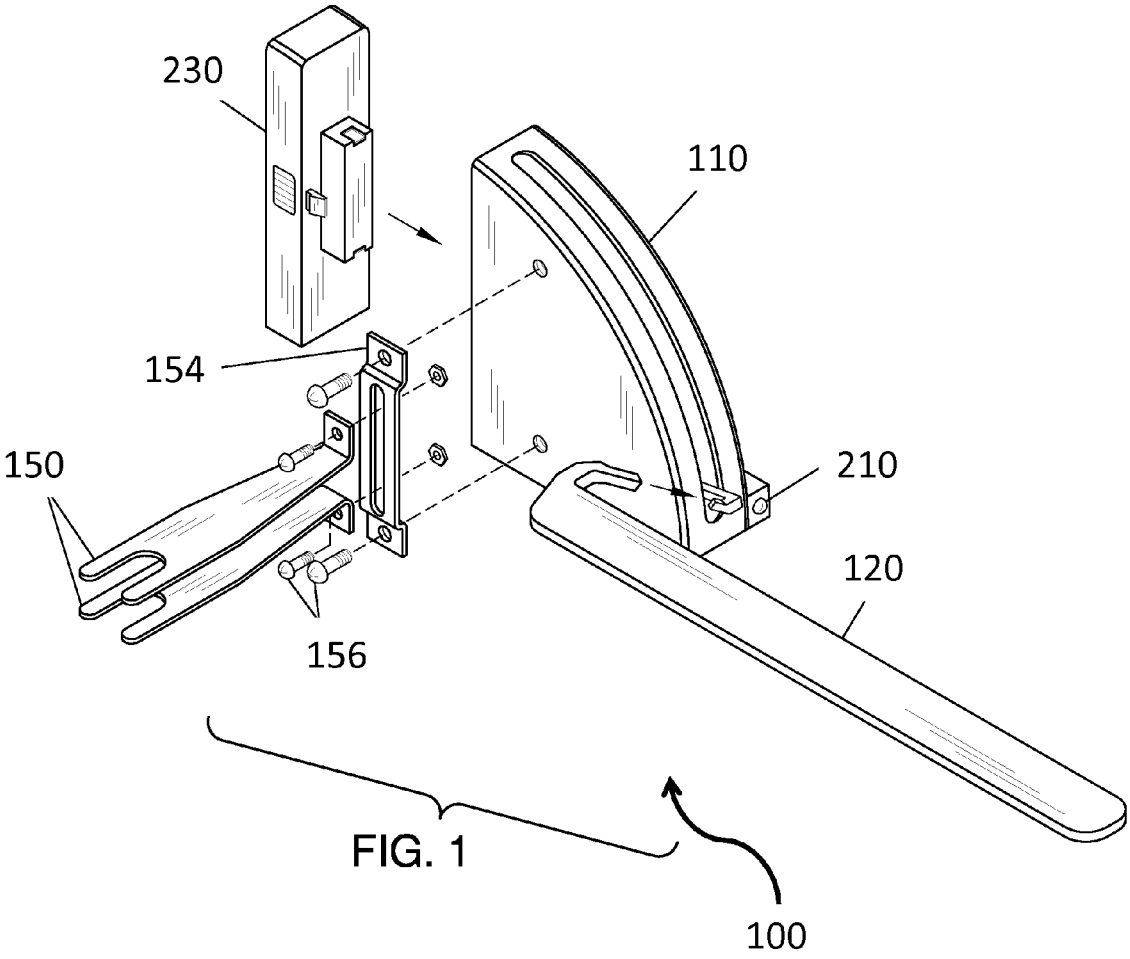
FIG. 1 is an exploded view of the toilet seat system of the present invention.
Figure 2:
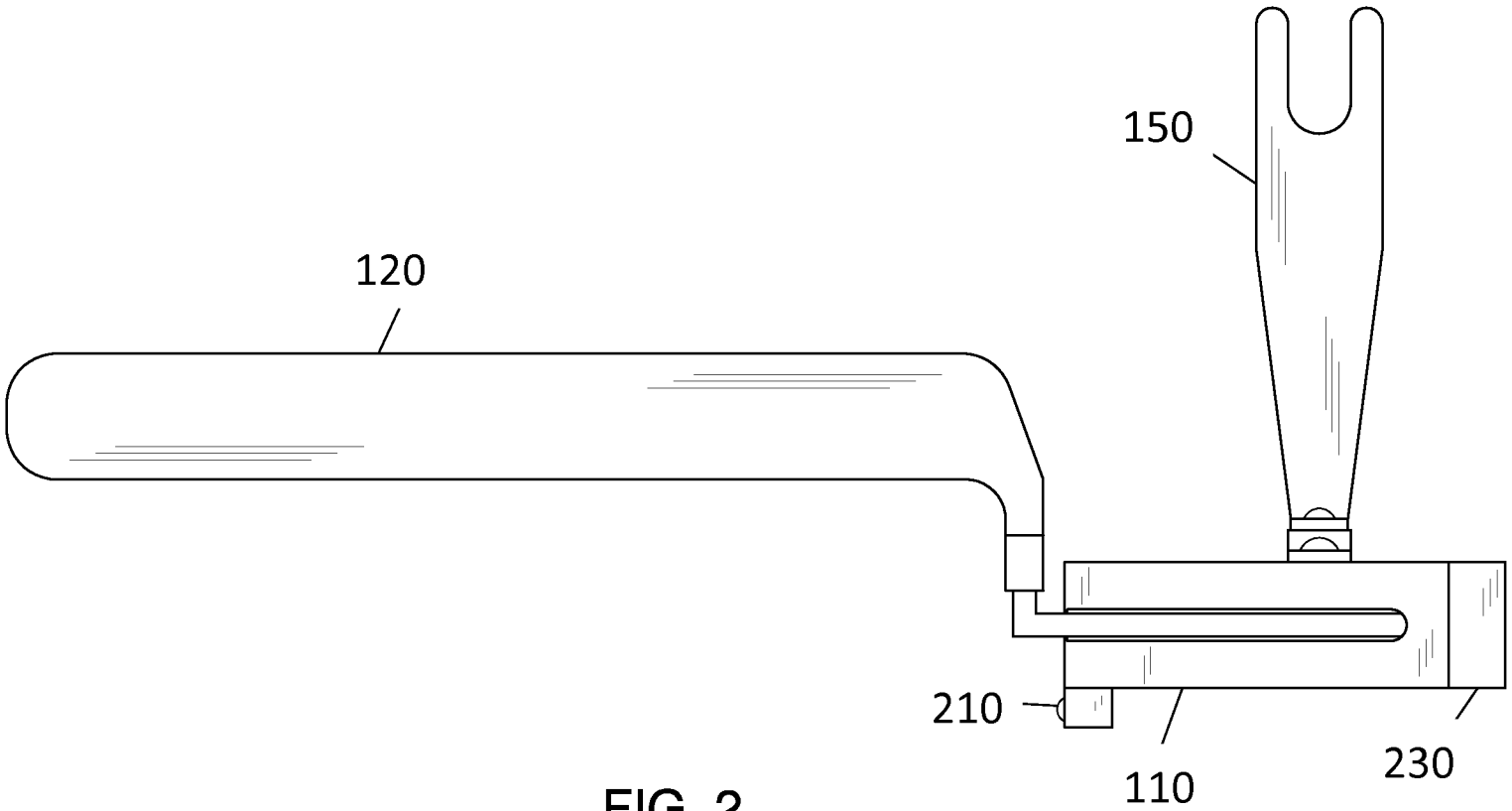
FIG. 2 is a top view of the toilet seat system of FIG. 1.
Figure 3:
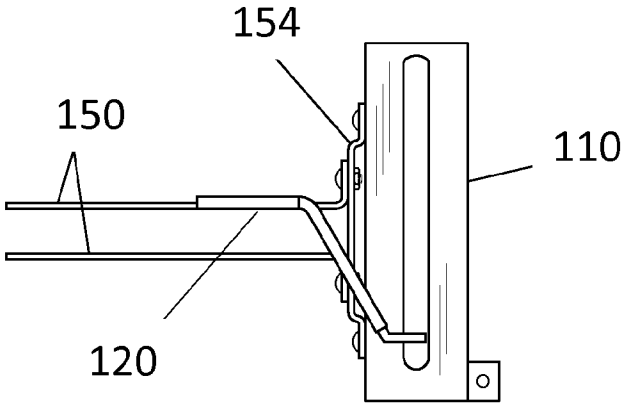
FIG. 3 is a front view of the toilet seat system of FIG. 1.
Figure 4:
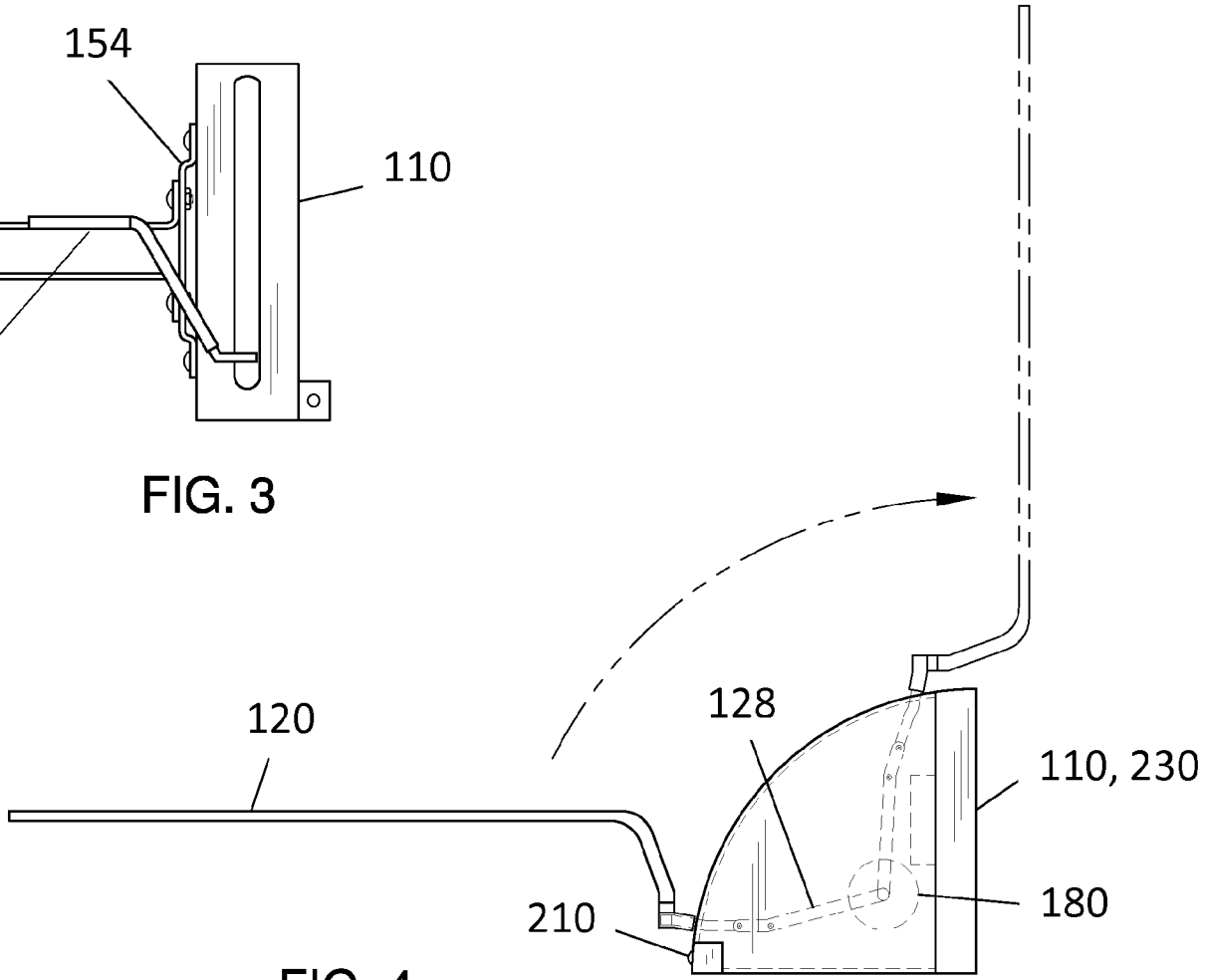
FIG. 4 is a side view of the toilet seat system of FIG. 1.
Figure 5:
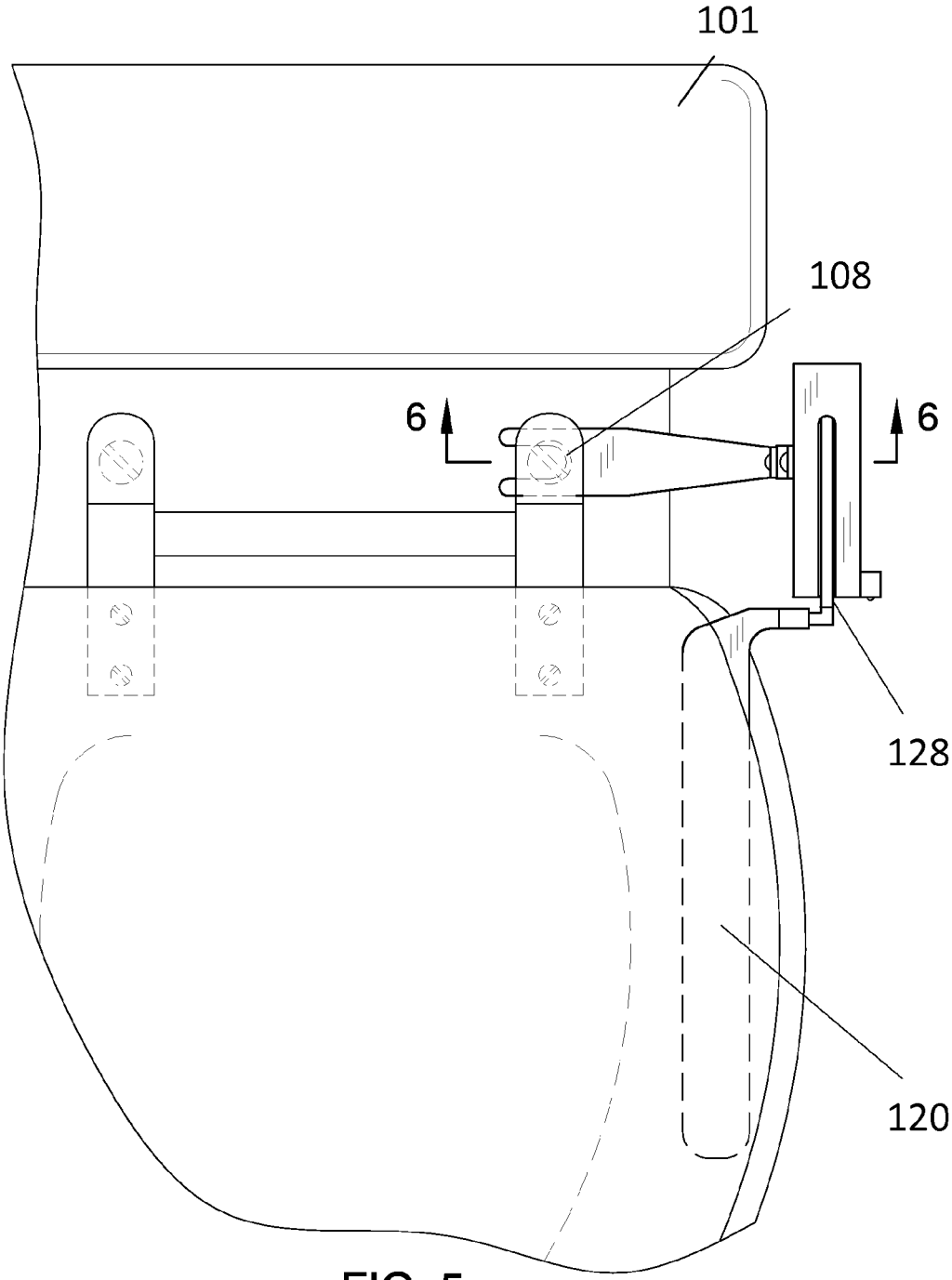
FIG. 5 is a top view of the toilet seat system of FIG. 1.
Figure 6:
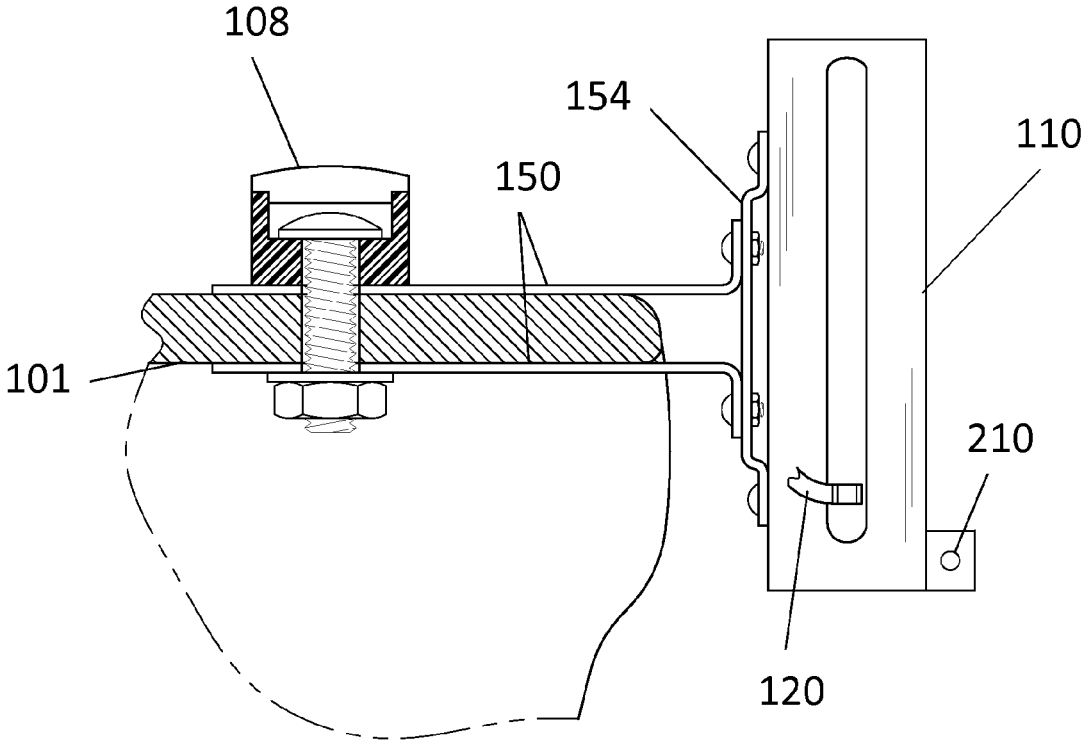
FIG. 6 is a front cross sectional view of the toilet seat system of FIG. 5.
Figure 7:
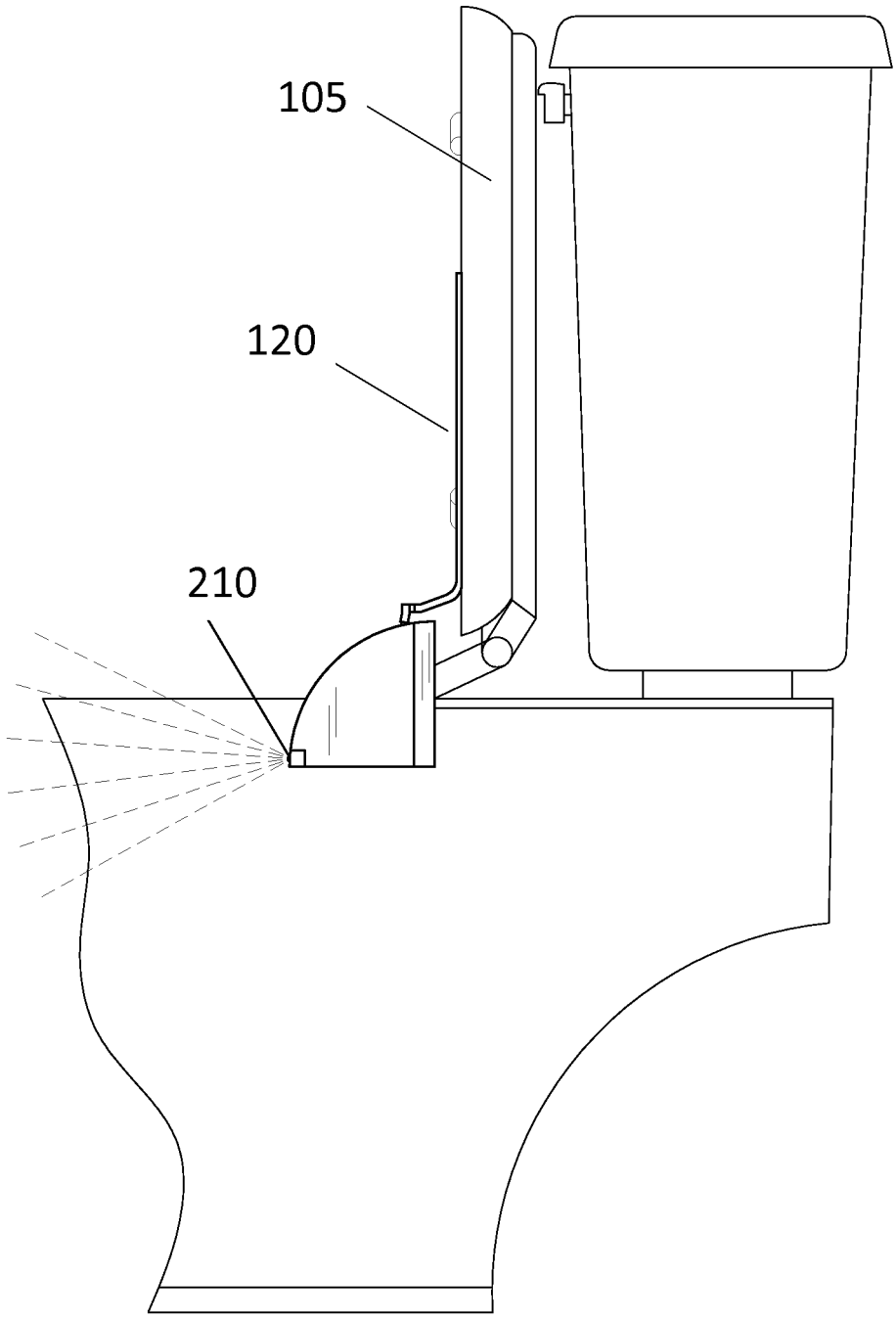
FIG. 7 is an in-use view of the toilet seat system of the present invention.
Figure 8:
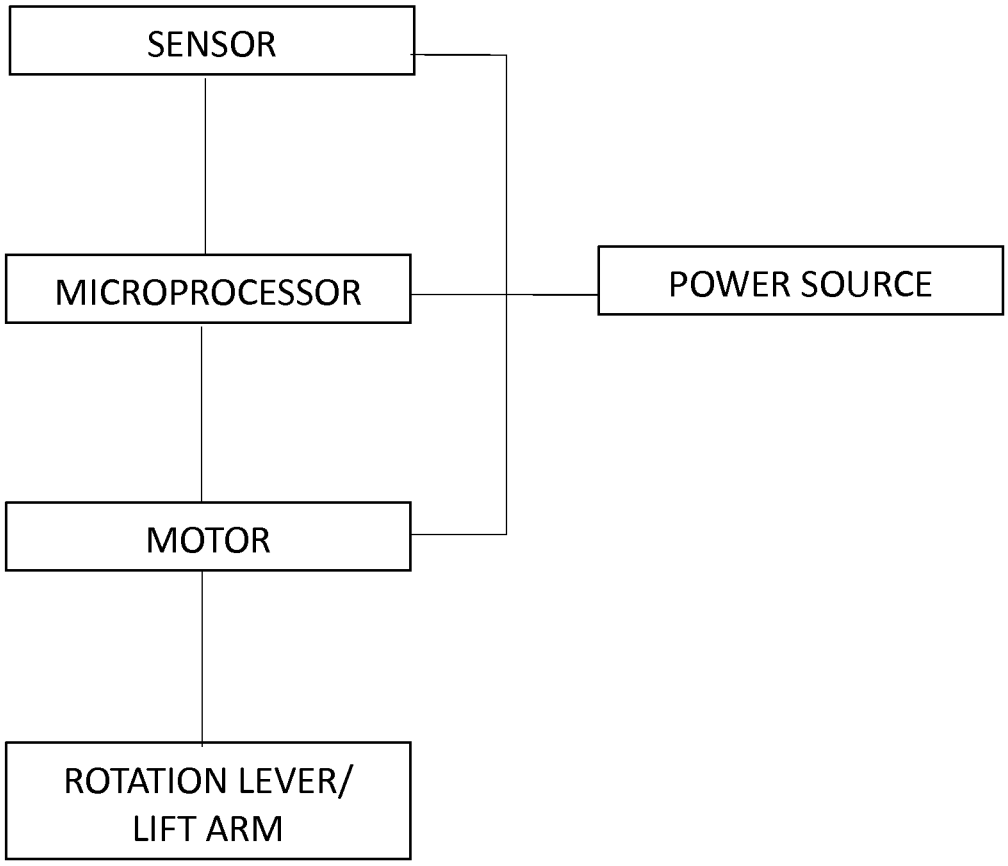
FIG. 8 is a schematic representation of the electrical components of the system of the present invention.

The toilet seat system 100 of the present invention comprises a lift arm housing 110 with a lift arm 120. The first end of the lift arm 120 is pivotally attached in the inner cavity of the lift arm housing 110, and the second end of the lift arm 120 extends outwardly from the lift arm housing 110. In some embodiments, a rotation lever 128 is pivotally attached to the inner cavity of the lift arm housing 110 and the first end of the lift arm 120 is attached to the rotation lever 128 while the second end of the lift arm 120 extends out of the slot of the lift housing 110. The lift arm 120 may be generally elongated and flat so as to fit below the toilet seat 105 and above the toilet bowl (see FIG. 5, FIG. 7). The lift arm 120 may be attached (e.g., fixedly, removably, e.g., via double sided tape, epoxy glue, etc.) to the bottom surface of the toilet seat. FIG. 5 shows the lift arm 120 curving inwardly with respect to the rotation lever 128 toward the toilet seat.

The lift arm housing 110 may be generally triangular in shape (rounded triangular, for example) comprising a horizontal bottom panel, a vertical back panel, two side panels, and a curved hypotenuse panel. A slot is disposed in the hypotenuse panel adapted to allow the lift arm 120 to pivot upwardly and downwardly.

The housing 110 is mounted to either the first side or the second side of the toilet 101 via one or more mounting brackets 150 (e.g., a top mounting bracket, a bottom mounting bracket). In some embodiments, the mounting brackets connect to a lid screw 108 installed in the neck of the toilet that secures the lid and the seat. These screws are standard screws that are found on all standard toilets (see FIG. 5). The mounting brackets 150 each have a first end that can be mounted to a side wall of the housing 110 (e.g., via a brace 154 and mounting hardware 156). The second ends of the mounting brackets 150 have indentations (e.g., about ⅛ inch, however the indentations are not limited to this size), which are adapted to snugly wrap around the lid screw 108 of the toilet 101. The mounting brackets 150 may be adjustable with respect to the attachment to the housing 110 to allow a user to install the system 100 appropriately. In some embodiments, the width of the outer surface of the indentation is wider than the bottom of the indentation such that the end of the brackets 150 can't pass through the indentation. The brackets may be secured from the opposite side via a hex nut or other mounting hardware. The present invention is not limited to the aforementioned mounting brackets nor is the present invention limited to mounting brackets for the purpose of mounting the housing 110 to the toilet.

A motor 180 is operatively connected to the rotation lever 128. The motor 180 is adapted pivot the rotation lever 128 upwardly and downwardly (e.g., between a horizontal and vertical position, see FIG. 4). Motors of this kind are well known to one of ordinary skill in the art. When the motor moves the rotation lever 128 upwardly to the vertical position, the lift arm 120 lifts up the toilet seat 105 to a generally vertical position (see FIG. 7). When the motor moves the rotation lever 128 downwardly to the horizontal position, the lift arm 120 moves the toilet seat 105 downwardly to the toilet bowl.

The motor 180 may be constructed in a variety of forms. For example, the motor 180 may be an electric (e.g., low voltage) mechanism or a hydraulic/air clutch mechanism. In the case of a hydraulic/air clutch mechanism, the mechanism may engage the pressure clutch when the toilet seat is raised. The seat would then lower. For example, after the seat is raised and the clutch is engaged a time delay (e.g., 2-3 minutes) may be initiated. After the time delay the seat may begin to lower. The motor 180 of the present invention is not limited to the aforementioned mechanism.

The motor 180 is operatively connected to a power source, for example a battery (e.g., a rechargeable battery, e.g., lithium, cadmium). In some embodiments, the power source is stored in a battery pack 230. The battery pack 230 may be removably attachable to the housing 110 (see FIG. 1), for example via off-set clips that push in and lock into the back of the housing 110. When the clips are inserted, they depress two spring action parts and then the clips hook into the inside of the housing. A release button may be disposed on the housing to allow the battery pack 230 to be released. The battery pack attachment is not limited to the aforementioned mechanism. The battery pack 230 may further comprise a charging port to plug in a charging cord to recharge the batteries.

The system 100 further comprises a sensor 210 (e.g., disposed on the housing 110, for example) operatively connected to the motor 180. The sensor 210 is operatively connected to a microprocessor, the microprocessor being operatively connected to the motor 180. In some embodiments, the sensor 210 may be activated only when an individual lifts the toilet seat 105. When the sensor 210 is activated in this manner, the sensor 210 sends a first input signal to the microprocessor whereupon the microprocessor causes the motor 180 to move the rotation lever 128 to the horizontal position after a time delay (e.g., 2 minutes, 3 minutes, 4 minutes, 5 minutes, etc. In some embodiments, the sensor can also detect when a user has left the area, thus sending a signal to the microprocessor to cause the motor 180 to move the lift arm 120 and rotation lever 128 to the horizontal position.

In some embodiments, the sensor 210 may be a motion sensor that can detect motion within a range, including a horizontal and vertical axis (e.g., between about 0 to 5 inches, between about 0 to 10 inches, between about 0 to 15 inches, between about 0 to 16 inches, between about 0 to 20 inches, etc.). The range of the sensor 210 is not limited to the aforementioned examples. Motion sensors are well known to one of ordinary skill in the art. In some embodiments, the microprocessor is adapted to receive a second input signal from the sensor 210 when the sensor 210 detects movement whereupon the microprocessor generates a second output command to the motor 180 to cause the motor to move the rotation lever 128 to the opposite direction of its current position. In some embodiments, the microprocessor is configured to incorporate a time delay after receipt of the second input signal.

The lift arm 120 may be removably attached to the rotation lever 128. For example, a male connecting end may be disposed on the first end of the lift arm 120 that engages a female connecting end on the end of the rotation lever 128. In some embodiments, the male connecting end of the lifting arm 120 is generally square in shape. This configuration may help prevent twisting and rotation of the arm 120. The female connecting end may slide over the male connecting end. This may allow for adjustability. The ends may be secured via a securing means (E.g., a deep set screw or awl). Gaps between the male and female ends may be filled with washers, for example. The adjustable nature of the arm 120 allows the arm 120 to be attached to the bottom of the toilet seat with minimal visibility and allows for easy and quick repairs.

The system 100 of the present invention may be constructed in a variety of styles and designs. For example, in some embodiments, the mounting hardware 156 and/or other components of the system 100 may be constructed to match the components of the toilet (e.g., polished, brushed nickel, chrome, gold, bronze, etc.).

In some embodiments, the system 100 further comprises a remote control (e.g., an infrared (IR) remote control, a radio frequency (RF) remote control, etc.), similar to those of car door remote controls. For example, an IR sensor may be disposed on the housing 110 or an RF remote can be built inside the housing 110. The remote control may comprise two buttons, an up button and a down button. Remote controls may benefit some individuals including but not limited to elderly or physically impaired individuals. A user can either use the remote control or the sensor 210 to regulate movement of the toilet seat 105.

In some embodiments, the system 100 of the present invention is modified to allow movement of the toilet seat and toilet lid independently. This may require the addition of a second housing and a second arm with a second motor, etc.

The present invention is not limited to the configurations and designs shown in the figures. For example, in some embodiments, components of the system 100 of the present invention may be constructed with rounded and/or soft edges for aesthetic appeal, for example.

As used herein, the term "about" refers to plus or minus 10% of the referenced number. For example, an embodiment wherein the range of the motion sensor 210 is about 14 inches includes a range that is between 12.6 and 15.4 inches. The present invention is not limited to a range of about 14 inches (see above for other ranges).

The disclosures of the following U.S. patents are incorporated in their entirety by reference herein: U.S. Pat. No. 5,878,444; U.S. Pat. No. 6,792,626; U.S. Pat. No. 6,067,667; U.S. Pat. No. 5,400,442; U.S. Pat. No. 5,153,946; U.S. Design Pat. No. D185,683.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A toilet seat system consisting of:

(a) a lift arm housing, wherein the lift arm housing is triangular in shape consisting of a horizontal bottom panel, a vertical back panel, two side panels, and a curved hypotenuse panel, wherein a slot is disposed in the hypotenuse panel of the lift arm housing;

(b) a rotation lever pivotally attached in an inner cavity of the lift arm housing;

(c) a lift arm consisting of a first end and a second end, the first end of the lift arm is attached to the rotation lever and the second end of the lift arm extends outwardly from the slot of the lift arm housing, the lift arm is for securing to a bottom surface of a toilet seat;

(d) a top mounting bracket and a bottom mounting bracket for together mounting the lift arm housing to either a first side or a second side of a toilet, wherein each mounting bracket consists of a first end for attaching to a side wall of the lift arm housing and a second end with an indentation adapted to snugly wrap around standard lid screws of the toilet;

(e) a motor operatively connected to the rotation lever, the motor is adapted to pivot the rotation lever and lift arm together upwardly and downwardly between at least a horizontal position and a vertical position;

(f) a power source operatively connected to at least the motor;

(g) a microprocessor operatively connected to the motor; and (h) a sensor disposed on the lift arm housing operatively connected to the microprocessor, the sensor is activated only when an individual lifts the toilet seat and thus lifts the rotation lever and lift arm to the vertical position, wherein the microprocessor is configured to receive an input signal from the sensor when the sensor is activated whereupon the microprocessor generates an output command to cause the motor to move the rotation lever and lift arm to the horizontal position after a time delay.

* * * * *